United States Patent [19]

Alexander et al.

[11] 4,284,504

[45] Aug. 18, 1981

[54] CENTRIFUGAL SPIN-ON FILTER OR SEPARATOR AND METHOD OF MAKING AND ASSEMBLING THE SAME

[75] Inventors: Willis R. Alexander, Hagerstown, Md.; Robert J. Shaltis, Hastings, Mich.

[73] Assignee: Hastings Manufacturing Company, Hastings, Mich.

[21] Appl. No.: 82,548

[22] Filed: Oct. 9, 1979

[51] Int. Cl.[3] ..... B04B 9/00

[52] U.S. Cl. ..... 210/168; 210/512.1; 233/23 R; 233/47 R

[58] Field of Search ..... 210/DIG. 17, 448, 168, 210/512 R, 440, 266; 29/598, 609; 233/1, 20, 23, 27, 47

[56] References Cited

U.S. PATENT DOCUMENTS

| | | | |
|---|---|---|---|
| 3,645,402 | 2/1972 | Alexander et al. | 210/266 |
| 3,726,403 | 4/1973 | Shaltis | 210/440 |
| 3,784,092 | 1/1974 | Gibson | 233/20 R |
| 4,046,315 | 9/1977 | Klingenberg et al. | 233/23 R |
| 4,106,689 | 8/1978 | Kozulla | 233/23 R |
| 4,165,032 | 8/1979 | Klingenberg | 233/23 R |

*Primary Examiner*—Theodore A. Granger
*Attorney, Agent, or Firm*—Munson H. Lane, Jr.

[57] ABSTRACT

The invention relates to a spin-on centrifugal filter or separator for purifying liquid such as oil used in an engine, and to the method of making and assembling the same. The completed separator is in the form of a spin-on cartridge having rotatably mounted therein a jet-actuated, centrifugal separator or rotor. The cartridge, which can conveniently be screw-threaded and thus of the spin-on type, comprises an outer housing or casing within which the rotor is mounted on a perforated hollow shaft depending from a spin-on cover for the cartridge which may be applied to the outer casing or housing after the rotor has been assembled on the hollow shaft. Liquid, e.g., oil, to be treated enters the cartridge from the engine casing, through a screw-threaded opening in the spin-on cover, passes to and through the hollow perforated shaft into the interior of the rotor where the liquid, under pressure, serves to impart centrifugal motion to the rotor, and passes outwardly from the rotor through jet openings therein. The resulting rapid rotation of the rotor separates heavy impurities from the liquid by centrifugal action, and the purified liquid then passes through an outlet in the housing or casing at the opposite end from the liquid inlet and thence back to the engine crankcase. More specifically the device comprises a spin-on centrifugal filter or separator cartridge adapted for use with the engine blocks of motor vehicles such as heavy duty trucks, or in smaller version in connection with lighter trucks or passenger cars and includes an outer spin-on casing or housing having inlet means for receiving oil under pressure from the engine block, said oil containing particles or contaminants of greater specific gravity than the oil when freed of such contaminants, an inner rotor unit adapted to receive oil from the housing inlet means, said rotor unit being mounted for rotation within the housing and having peripherally mounted reaction jet openings for imparting rotation to the rotor unit when oil under pressure passes through the jet openings, and baffled outlet means at the opposite end of the housing or casing from said inlet means.

14 Claims, 9 Drawing Figures

CENTRIFUGAL SPIN-ON FILTER OR SEPARATOR AND METHOD OF MAKING AND ASSEMBLING THE SAME

BACKGROUND OF THE INVENTION

Centrifugal filters or separators have been known for some time but have not been without problems in the cost of manufacture, ease of assembly and use on the automobile engine or any type of engines where such filters are typically found. Often these separators include clamping mechanisms which are spring-loaded to the extent that tools are usually required in removing those portions of the housing to permit access to the internal operating portions of the separator. In addition, threaded rods and nuts are usually included to secure the shafts and other portions of the rotary unit to the remainder of the housing on or adjacent to the engine. This has made those separators relatively expensive to manufacture because of the complexity of the parts involved and difficult to operate because of the nature of the attachment mechanisms particularly.

Not only the construction and assembly, but also, the mode of operation of these separators has been deficient in several areas. Proper flow paths may not always be established to ensure that the particles within the fluid being treated are thrown toward the peripheral portions of the rotary unit. In addition, the centrifugal force imparted to the fluid as it leaves the rotary unit often causes the fluid to swirl as it is delivered from the separator to the engine. The swirl remaining with the oil as it is dispensed from the separator reduces the effectiveness of the oil, because the desired flow pattern is not always achieved.

The invention includes several features which overcome the problems which have characterized the prior art in construction, mode of operation, and result. As explained above, a feature of the invention relates to a construction which improves the assembly procedures and reduces cost to the extent that the unit is rendered disposable. For example, the rotary unit includes a rigid, inlet shaft which is resiliently-fixed within the filter housing. A biasing mechanism or adapter is located adjacent the bottom of the housing for engagement with the bottom portion of the rigid shaft. In this way, the rotary unit with the rigid shaft in place is pressed against the biasing mechanism when the top of the housing is in place such that the shaft is biased against the top of the housing in a manner which secures the rotary unit in the correct position even during rotation at high speeds. By using such a construction, the threaded rods, nuts and external, spring-operated clamping mechanisms can be eliminated without loss in efficiency of the unit.

To achieve the desired flow pattern within the rotary unit, an upper baffle plate is located beneath the liquid inlet and this baffle plate, typically, extends from a hollow sleeve mounted on a non-rotating hollow shaft about which the centrifugal unit rotates. In this manner, as the fluid is forced under pressure through the inlet tube and the surrounding hollow shaft, the fluid is directed toward the peripheral elements of the rotary unit by the upper baffle plate before being directed to the bottom portion of the rotary unit for explusion. The rotary unit also has a lower baffle member extending from the interior, peripheral surface of the rotary unit towards its central portion. The latter baffle terminates to leave an open area near the central tube of the rotary unit for the cleaner fluid, but not the separated contaminants, to pass to outlet jets near the bottom of the rotary unit.

Baffled outlet means including vanes are located in the bottom portion of the housing beneath the jets of the rotary unit and above the outlet of the housing. Thus, the liquid leaving the rotary unit is subjected to stabilizing effect of the vanes prior to being dispensed through the outlet of the separator. This ensures that the fluid has the desired flow characteristics before being delivered to the engine. Such baffled outlet means may comprise a plurality of stationary vanes or may be in one piece.

In addition to all of the features which characterize the construction and operation of the separator, the attachment feature is one which adds to the simplicity of operation of this device. The top member forming the top of the housing is of the spin-on type which has a threaded internal surface allowing the entire separator to be spun on to a complementary connection on or adjacent the engine. Thus, once the separator has been used and requires replacement, it can be simply spun out of its connection and disposed of. Furthermore, as can be seen from the above discussion, not only is the centrifugal separator of the invention economical, but its efficiency is enhanced by the maintenance of the desired flow pattern of the baffle means as well as the straightening of the centrifugal motion of the fluid by the stationary radial vanes or baffle means, as the fluid leaves the housing. These features as well as others will be better appreciated in the following detailed discussion of the preferred embodiments.

SPECIFIC EMBODIMENT

More specifically the invention may comprise a centrifugal spin-on filter or separator cartridge which is adapted for use with heavy duty trucks, or, in a smaller version, may be used with lighter trucks or passenger cars. The device may also be used in conjunction with stationary engines, as well as those of motor vehicles.

There have been some centrifugal separators available for years, so the state of the art is old; however, to our knowledge, there has never been a throw-away centrifugal filter. The units we are familiar with are quite expensive, and have an inner cartridge that must be cleaned and then replaced into the separator assembly. This is time consuming, difficult and of course, expensive.

Our invention is a relatively inexpensive, simply constructed centrifugal separator which can be readily attached to and detached from the cast iron base or block of an engine. Most advantageously, this connection is of the spin-on or screw-threaded type. In the device, a liquid such a lubricating oil is introduced into the center portion of the separator and flows into an inner rotary unit which has baffles to direct the oil to the outside and then, picking up the cleaned oil, next to the center tube prior to its going to jets in the bottom of the can which give the force to spin this can at a high rate of speed. There are straighteners in the bottom of the can or outer shell to stop the spinning action, allow the oil to drain from the outer shell; the oil is drained back into the crankcase of the engine. A smaller version may be used, for instance, with passenger cars or lighter trucks as a supplementary filtering or separating system. It is contemplated that the inner rotary element or rotor may be replaced, keeping the outer spin-on housing, can or canister shell as a unit.

PRIOR ART

I am generally familiar with prior art, but know of none which discloses a centrifugal oil separator having a spin-on canister end as shown in the accompanying drawings. Centrifugal separators which include an outer casing, an inlet stem supported centrally within the casing, a drum rotatably mounted relative to the inlet stem, and reaction jet nozzles provided in the drum through which pressurized liquid is discharged to rotate the drum are disclosed in a number of patents including the following:

U.S. Pat. No. 2,650,022; Fulton et al.; Aug. 25, 1953
U.S. Pat. No. 2,723,079; Fulton et al.; Nov. 8, 1955
2,755,992; Tait et al.; July 24, 1956
U.S. Pat. No. 2,799,448; Lee; July 16, 1957
U.S. Pat. No. 2,865,562; Burke; Dec. 23, 1958
U.S. Pat. No. 3,432,091; Beazley; Mar. 11, 1969
U.S. Pat. No. 3,762,633; Ishii; Oct. 2, 1973
U.S. Pat. No. 3,784,092; Gibson; Jan. 8, 1974
U.S. Pat. No. 3,991,935; Henning; Nov. 16, 1976

With respect to these disclosures significant novel features are present in our spin-on separator, particularly with respect to the baffles in the rotary unit and the bottom of the separator, the spring support for the rotor bearing, and the spin-on end for the separator canister.

Attention is also called to our U.S. Pat. No. 3,645,402 showing a combined cooler and filter having a spin-on outer canister, can or shell depending from a cast iron support such as an engine block. However this patent does not disclose an inner centrifugally-operated rotary separator as in the present invention.

In regard to patents already issued on centrifugal separators or filters, it is apparent that our design is much simpler and can be manufactured more easily than the previous units. All of these have two-piece outer housings which are more difficult to seal and maintain. Our invention is a spin-on, throw-away device which requires less maintenance time in the field.

Our design affords easy assembly of the components, and is designed to be readily manufactured by normal procedures. Among the significant features of our device are the straightening vanes with an adaptor and spring at the outlet of the unit to hold the rotor assembly in proper position in the housing. The rotor assembly is a unit unto itself, being on the main support, fluid inlet shaft which holds the assembly in proper position in the main housing. The rotary unit in our device is supported on a separate inlet shaft which aligns the two ends of the rotary unit and provides a bearing surface for the bearings of the rotary unit. Our device uses jet pots or cups that would be operatively mounted in the can wall with the discharge orifices being aligned properly at the time of assembly into the canister.

These pots are also located near the outer extremity of the body of the rotary unit to give maximum torque for rotation.

The placing of the baffles in our device is unique in that we have an upper baffle that directs the oil as it enters the rotating unit to the circumference of the filter where the highest centrifugal force is applied. A lower baffle in the rotary unit allows the clean oil, which would be near the axis of a rotating chamber, to go to the jet pot orifices. The lower baffles also keeps the sludge separate from the fluid to move the jet pots.

The design of the coil spring that resiliently mounts the rotary unit is such that it holds the assembly in place against an upper reinforcing plate during normal operating pressures. If abnormal high pressure is received, it is possible that the whole assembly could be backed off the seat against the reinforcing plate, relieving this pressure momentarily, then receding to normal operation. There can be a soft gasket at this point to afford a seal where contact is made with the reinforcing plate.

The centrifugal separator of this invention is easily adapted to an engine oil filtering system. For example, one may have two spin-on, full-flow filters treating the mainstream of the engine as well as the oil going as bypass to the centrifugal separator of the present invention. The improved separation obtained by our centrifugal device may lead to reduced engine wear, and longer engine life. Instead of having the centrifugal separator mounted between two spin-on, full-flow filters, the centrifugal separator may be used at one side of the full-flow filters without departing from the spirit of the invention. Also instead of using two full-flow filters as shown, one or more full-flow filters may be used, and one or more centrifugal separators may be employed without departing from the spirit of the invention in its broadest aspect.

BRIEF DESCRIPTION OF THE DRAWINGS

The invention will be more readily understood by reference to the accompanying drawings and the following detailed description in which specific embodiments of the invention are set forth by way of illustration and not by way of limitation, it being understood that numerous additional modifications and variations may be resorted to without departing from the spirit of the invention in its broadest aspects as will be apparent to those skilled in the art.

In the drawings.

DETAILED DESCRIPTION OF A SPECIFIC EMBODIMENT OF THE INVENTION

FIGS. 1-2

Figure 1:
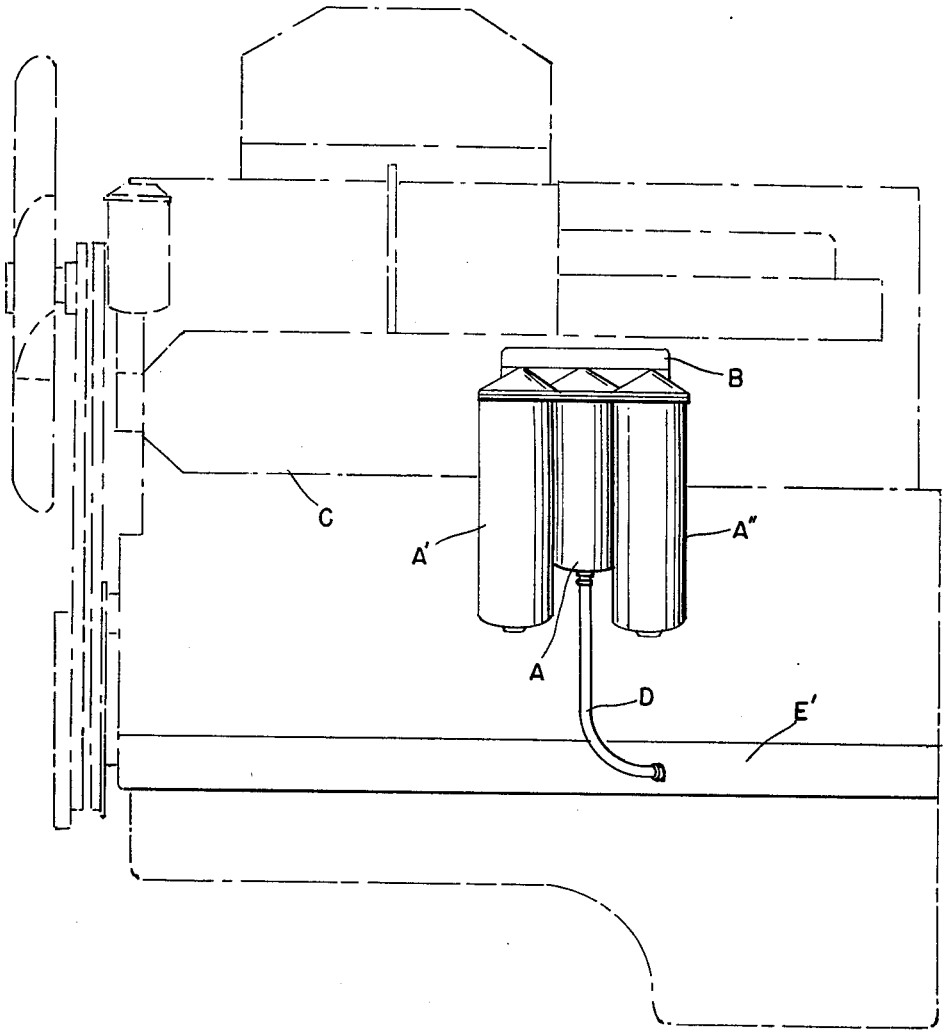
FIG. 1 is a diagrammatic view showing an engine and associated parts of a heavy duty vehicle including the engine cylinder block through which oil to be filtered is discharged into a plurality of removable filter or separating units, cartridges, or cans, one of which units houses our improved, centrifugal separator. This unit receives fluid to be treated from a cylinder block at one end and returns purified oil to the crankcase at the other end.

Referring to the drawings, and particularly FIG. 1, A denotes generally a screw-on, removable cartridge unit comprising an outer casing or housing having rotatably mounted therein a centrifugal separator embodying our invention, as more specifically shown in FIGS. 3, 4, 5, 6, and 7.

Figure 2:
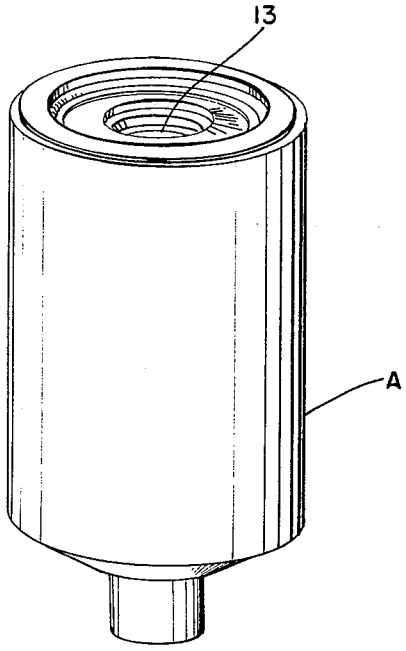
FIG. 2 is a perspective view of the exterior of one of the replaceable units, all of which units may be similar in exterior appearance, although they may be of different sizes.

The cartridge is shown as a separate unit A in FIG. 2 and is similar in outward appearance and removability with respect to the full-flow filter units or cartridges A' and A". The cartridges A, A' and A" may be of any desired size, a larger size being for use with heavy duty trucks, and smaller sizes for use with smaller trucks and passenger vehicles. Also the invention can be used in conjunction with stationary engines.

In FIG. 1, the unit or cartridge A is shown mounted on the engine of a six cylinder truck.

The device does not require any specific orientation, although with any large separator, it is most advantageous to have it installed in a pendant position such as in FIG. 1. This is due to the vibration effects of a unit in a horizontal position being more severe than if the separator is in a pendant position. The latter does not require as massive an attachment arrangement.

Referring again to FIG. 1 of the drawings, unit A denotes a cartridge, can or canister enclosing a centrifugal separator embodying our invention. The cartridge is of the screw-on type and is shown pendent from a cast iron base or block B of an engine C, in a manner similar to that disclosed in our U.S. Pat. No. 3,645,402 and in Shaltis U.S. Pat. No. 3,726,403. As previously set forth, the device does not require any specific orientation, although the pendent position is preferred.

Figure 4:
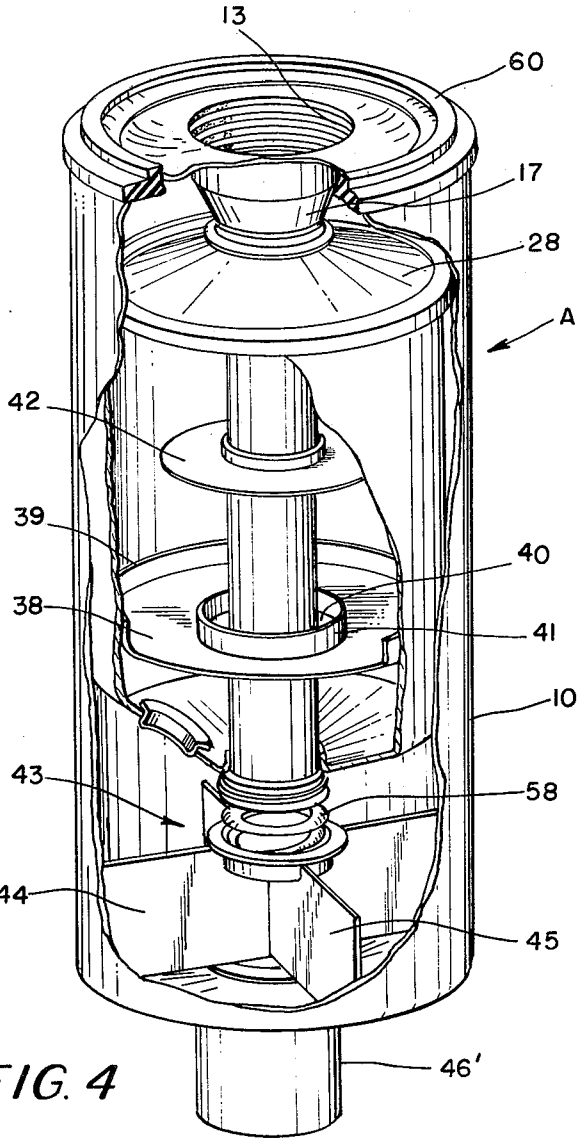
FIG. 4 is a perspective view of the spin-on unit shown in FIG. 3 but on a smaller scale, with the outer casing partly broken away to show the interior.
Figure 3:
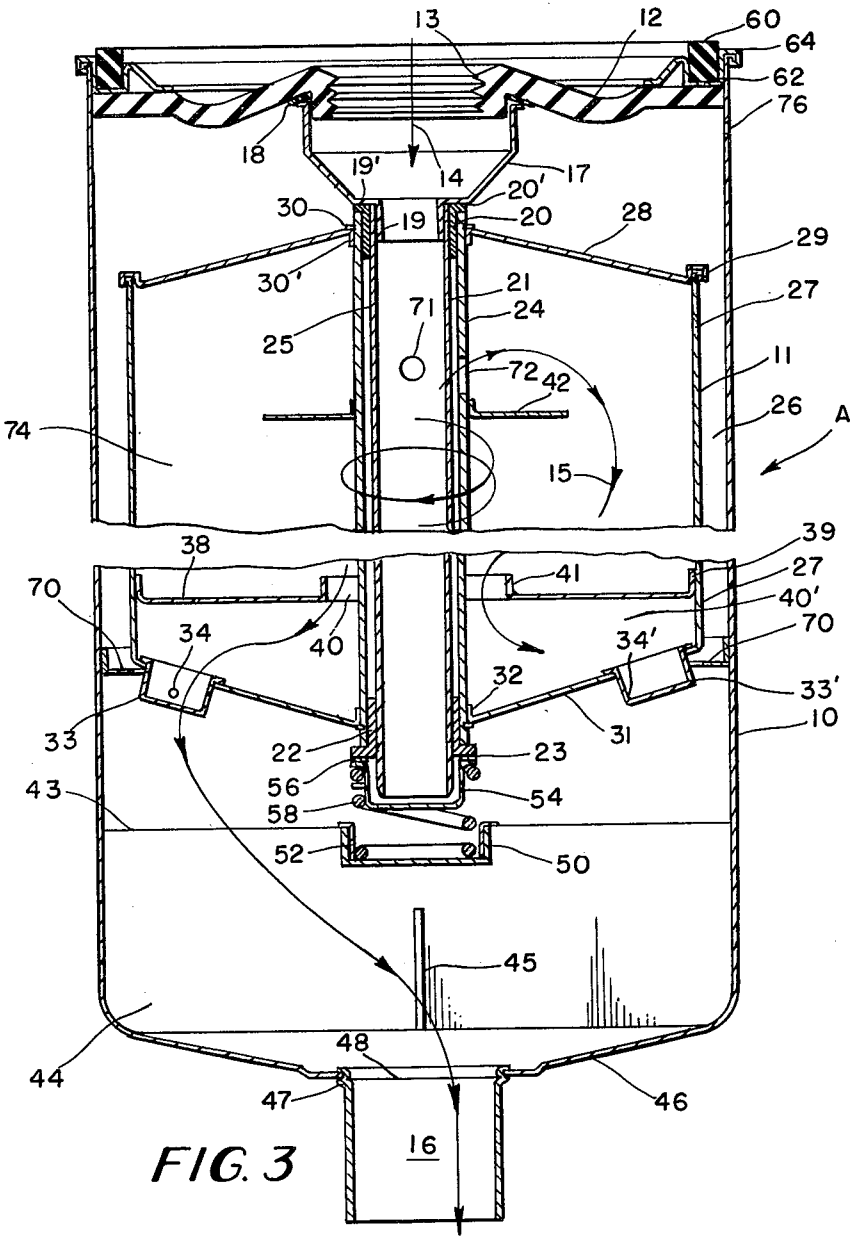
FIG. 3 is a longitudinal sectional view of a spin-on unit containing the centrifugal rotary separator mounted within the outer canister or housing of the unit.

As is further shown in FIG. 1, additional spin-on filter units A' and A" may be used in connection with the separator unit A. The unit A which contains the centrifugal separator rotatably mounted therein as shown in FIGS. 3 and 4 is provided with a removable outlet tube or pipe D for returning treated oil to the crankcase E, whereas the units A' and A", while similar in outward appearance, are intended to represent full-flow filters for filtering the main body of oil for the engine, as well as the oil going to the centrifugal separator unit A, designed in this case to handle only a minor portion of the total amount of oil being passed to the filtering system for treatment and return to the engine. The outlet tube D may be a flexible tubing which may be provided with screw-threaded means for attachment to the outlet end of the unit A.

Any number of full-flow filters may be used with the centrifugal separator unit A and instead of having the centrifugal unit A placed between the two full-flow units A' and A", the unit A may be at one side of the full-flow units A' and A". Also any desired number of full-flow units may be employed in connection with one or more centrifugal separator units.

The unit A will now be more fully described with particular reference to FIGS. 3 and 4. As shown this unit includes an outer cylindrical casing or housing 10, and an inner centrifugal rotary separator unit 11 mounted therein. The cylindrical housing or shell 10 is provided with a heavy cover 12 at one end thereof shown snugly fitting within the cylindrical wall of the housing, and having a screw threaded inlet 13 for receiving oil to be treated for removing impurities therefrom as the oil passes into and through the rotory separator unit 11 as indicated by the arrows 14 and 15, and then re-entering the outer casing at the lower portion thereof, and passing out through an outlet 16 at the opposite end of the housing or shell from the inlet 13. The outlet 16 corresponds generally with the outlet pipe or tubing D shown in FIG. 1, and is connected to the crankcase E as indicated in FIG. 1. A screw threaded outlet may be employed as indicated in FIG. 1 or a smooth outlet connection may be provided as shown in FIG. 3, over which a flexible tube may be applied. The inlet 13 in the cover 12 may also be screw threaded as shown for attachment to the base B (FIG. 1) having a complementary screw threaded connection.

Construction of Unit A

The construction of the completed unit or cartridge A will be first described in detail and thereafter a preferred mode of assembly and of operation will be described.

Depending from the cover or plate 12 is a funnel-shaped member 17 or adapter having a sealing gasket 18, preferably of elastomeric material such as rubber to prevent leakage of fluid when pressed against the cover 12. The funnel member is provided with a reduced neck portion 19, snugly fitting within an upper rotor bearing member 20 and may be suitably secured thereto to prevent relative rotation. A friction fit may be sufficient for this purpose.

The bearing 20 is shown as provided with a peripheral flange or collar 20', engaging a shoulder 19' at the juncture of the enlarged portion of the funnel 17 and the reduced neck portion 19. A hollow, non-rotating stem or shaft 21 is fitted and secured within the bearing 20 and terminates beyond the lower end of the rotor 11 but short of the outlet 16. A second bearing 22 having an outwardly directed annular flange or collar 23 is secured to the shaft 21 near the lower end thereof providing a second bearing for the rotor element 11.

Rotor Unit 11

The rotor unit 11 will now be more fully described. As shown, this unit is mounted for rotation on the upper and lower bearings 20 and 22 secured at the ends of the stationary inner shaft 21, which in the completed apparatus, depends from the lid or cover 12 of the stationary outer housing, and is provided with a foraminous sleeve 24 rotatable about the shaft 21 and spaced therefrom by bearings 20 and 22 as indicated at 25. The rotor unit 11 is provided with an outer cylindrical wall portion 27 spaced from the wall of the housing 10 as indicated at 26. A sloping cover 28 is provided at the upper end of the rotor unit 11 which, in the completed device, is connected to the wall or casing 27 by a spun joint 29 after the inner parts of the rotor have been assembled. The cover 28 of the rotor unit 11 is centrally apertured and a sealing gasket 30 is preferably provided therearound to prevent leakage of oil.

The lower end 31 of the rotor unit 11 is preferably formed integrally with the wall portion 27 and slopes downwardly and inwardly therefrom, and engages and is secured to the rotor sleeve or shell 24 by means of an upturned flange 32, surrounding a central opening in end 31.

Reaction jet cups or pots 33,33' are shown as separate units peripherally mounted in the sloping end wall 31 and may be secured thereto in any suitable manner as by welding or staking. Reaction jets 34,34' are formed in the cups 33,33'. The general operation of the reaction jets in a centrifugal separator or rotor is known and described, for example, in U.S. Pat. No. 3,762,633, previously referred to.

A baffle plate 38 is shown spaced above the sloping bottom 31. The plate 38 may be secured to the wall 27 of the centrifugal rotor 11 by means of an upturned flange as indicated at 39, and an opening 40 is provided around and spaced away from the sleeve 24 to provide an annulus through which oil from which the heavier contaminants or impurities have been separated by centrifugal action of the rotor and collected on the rotor wall 27 can pass as indicated by arrows in FIG. 3. An upstanding collar 41 is provided on plate 38 surrounding the opening 40 through which the treated oil is passed to the jet pots as indicated by the arrows. Spaced above the plate 38 is an upper baffle or plate 42 secured to and rotating with the sleeve 24 when the rotor is activated by means of the jets 34,34'.

Outer Housing 10 of Unit A

The screwed on stationary outer housing or casing 10 of unit A will now be more fully described in its relation to the rotor 11. The housing 10 is or may be similar to the housings of known spin-on cartridges, cans or canisters such as shown, for example, in our U.S. Pat. No. 3,645,402 previously referred to, but in accordance with the present invention, certain changes are preferably made in the housing. Thus stationary members, flow-straightening means or stators 43, herein shown as comprising a pair of intersecting stationary blades or baffles 44 and 45, are provided in the lower portion of the outer casing 10 and suitably secured thereto as by welding. Also the rounded base 46 of the housing 10 is provided with the outlet 16 previously referred to, through which treated oil may be returned by line D to the engine crankcase E as illustrated in FIG. 1 of the drawings.

An outlet tube or collar 46' may be secured at the center of the rounded bottom, as by means of a spun-on connection 47 surrounding a central opening 48, or a screw-thread connection may be provided for an outlet tube D as illustrated in FIG. 1. If the connection 46' is smooth, a flexible connector or tube may be applied to the exterior thereof. The purpose of the baffles or ribs 44, 45 is to stop the spinning action of the oil as it emerges from the jets 34, 34' of the rotor 11 and to allow the oil to drain from the outer shell 10 back into the crankcase E of the engine.

As a feature, spring pressed means are provided within the outer casing 10 mounted on the flow-straightening means 43 for forcing the rotor unit 11 and associated parts into frictional and sealing engagement with the underside of the heavy covering or lid 12 of the housing 10. As shown the tops of the intersecting blades 44 and 45 of the stator unit 43 are cutaway centrally as indicated at 50 to provide a seat for a spring receiving cup or adapter 52. A second adapter cup 54 is provided with a radial flange 56, one end of which contacts the flange 23 on the bearing 22 at the lower end of the shaft 21.

Thus the stator unit 43 serves as a pedestal or stand for supporting the biasing spring receiving cup or adapter 52. As shown, the stator unit 43' is secured as by welding to the lower portion of the outer casing 10, and the adapter cup 52 is spaced a substantial distance from the outlet opening 48 to the outlet passage 16 as contrasted with prior art devices wherein a rotor unit having a biasing spring is mounted directly on the outlet opening. This arrangement has been found in practice to be economical and to assist in assembly. The construction of the stator unit or pedestal 43 allows treated liquid from the rotor to pass freely to the outlet 16. Other forms of stator units or pedestals are shown in FIGS. 5, 6, 7, 8, and 9, and will be more fully described hereinafter. These forms of stator units or pedestals may be in one piece and secured to the lower portion of the outer casing 10 as by welding and are provided with apertures or openings, permitting free passage of treated liquid to the outlet 16.

The underportion of the flange 56 coacts with one end of a coil spring 58, the other end of which is seated in the cup 52. The spring serves to urge the cup 54 upwardly together with the shaft 21 and parts associated therewith, and the funnel 17, and force the same into sealing contact with the undersurface of the lid or cover 12 of the housing 10. The cup 54 serves as a cover for the lower end of the non-rotating hollow shaft 21.

Figure 5:
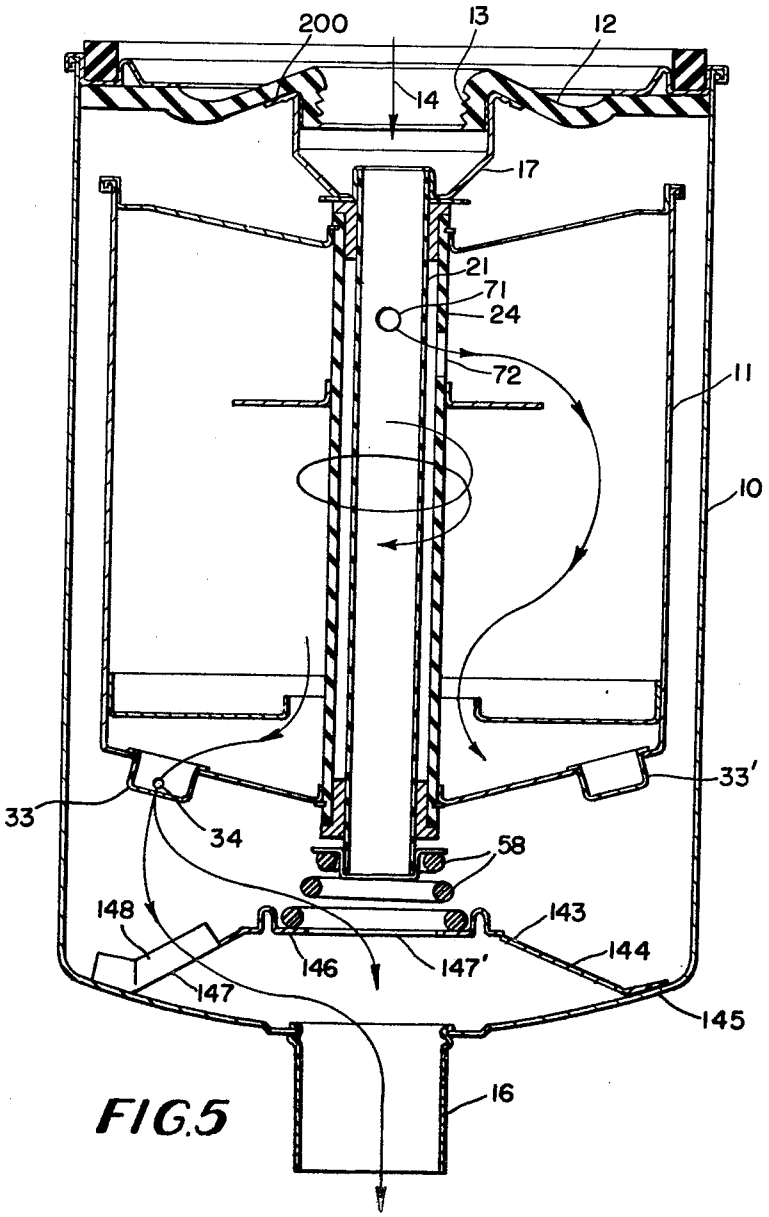
FIG. 5 is a view similar to FIG. 3 but showing a modification.

In the embodiment of the invention shown in FIGS. 3 and 4, the funnel-shaped adapter 17 is provided with an integral peripheral flange which is forced into sealing contact with the under surface of the heavy lid or cover 12 of the housing 10 as previously described. Such sealing contact is improved by the use of a sealing ring 18 interposed between the peripheral flange of the funnel adapter 17 and the under surface of the lid or cover 12. As shown, the sealing ring surrounds the threaded inlet 13 of the casing. In this construction (FIGS. 3 and 4) which has been found preferable for certain purposes, no weld is provided between the flange of the adapter funnel and the under surface of the cover such as is shown in FIG. 5 wherein the attaching means for the rotor including the funnel 17 is permanently fixed to the lid 12 of the outer casing. In the forms shown in FIGS. 3 and 4, the lid 12 is removable separately from the rotor unit which arrangement is found advantageous in the assembly of the device.

Separator Cover 12

A sealing contact between the cover 12 of the spin-on separator cartridge housing 10 and the block B (FIG. 1) is provided by flexible elastomeric sealing ring 60 mounted in an annular seat 62 on the cover 12 and shown as peripherally secured to the upper rim of the housing 10 by means of a spun-on connection 64 similar to that shown in our U.S. Pat. No. 3,645,402 (see particularly FIGS. 1 and 5), and Shaltis U.S. Pat. No. 3,726,403.

Baffle Plate 70

Also there is an annular baffle plate 70 shown as projecting inwardly from the outer casing 10 adjacent the peripheral reaction jet cups 33, 33' in the end plate 31 of the rotor 11. As shown the baffle plate 70 is located slightly above the level of the jets 34,34'. This baffle serves the purpose of preventing or reducing flow of oil upwardly through the space 26 in the casing 10 after leaving the rotor 11.

Additional Features

Additionally, the non-rotating stem or shaft 21 is provided with one or more apertures 71, which when the rotary sleeve 24 of the rotor 11 is mounted on the end bearings 20 and 22 of the shaft 21, communicate with the space 25 between stationary shaft 21 and rotary sleeve 24. The rotary sleeve 24 is provided with one or more apertures 72 shown as located above the annular deflector 42; the apertures 72 communicate with the interior 74 of the rotor 11. One or more small bleed openings 76 may be provided in the upper portion of the housing 10, preferably just below the cover 12 in order to release excessive pressure when necessary.

As shown, the apertures 71 and 72 are in substantial alignment and are relatively large in size to provide direct and unobstructed communication with the interior of the rotor unit, and the upper baffle plate of the flange 42, which is secured to the rotor sleeve 24 and rotates therewith, serves to direct liquid outwardly toward the outer wall of the rotor unit prior to passage to the lower stationary plate 38 which is provided with collar 41 surrounding the opening 40. The direction of the flow of liquid through the apertures 71 and 72 and through the rotor is indicated by the arrow 15.

Assembly

The preferred method of assembling Unit A comprising the outer spin-on casing or housing 10 with attachments previously referred to, and the inner rotor 11 with attachments previously described will be largely apparent from the foregoing description and accompanying drawings, but will now be more fully described.

In general, the housing 10, which may be of known form as shown, for example, in our U.S. Pat. No. 3,645,402, and in Shaltis U.S. Pat. No. 3,726,403 may be modified by providing an outlet opening 48 in the bottom 46 thereof, flow-straightening means 43 in the form of intersecting vanes 44 and 45, annular deflector member 71, and bleed openings 76. The spring supporting adapter cup 52 may be inserted in the cutaway portion 50 at the intersection of the vanes 44 and 45 or may be suitably secured in place, or the cup may be applied later at the time of assembly of the rotor.

It will be understood that the rotor unit is first assembled outside the cartridge, casing or housing 10, and the rotor unit 11 placed within the housing 10 upon the spring 58 either before or after the funnel adapter 17 is in place. Thereafter the cover 12 is applied to the outer casing 10 as will be more fully described hereinafter.

The rotor unit 11 is built about the non-rotating shaft 21. In forming the rotor, the lower end cover 31 of the rotor which is shown integral with the side wall 27 is provided with an opening surrounded by collar 32, of sufficient size to permit passage of the shaft 21 with the sleeve 24 loosely assembled thereon.

The jet cups 33, 33' are inserted and secured peripherally in the end cover 31 and jet openings 34, 34' are formed therein either before or after assembly. The sleeve 24 is loosely assembled over the inner shaft 21 and the ends thereof extend beyond the central opening in the end cover 31. Thereafter, the lower bearing member 22 is inserted from beneath between the shaft 21 and the sleeve 24. The lower end of the sleeve 24 rests upon the flange 23 of the bearing 22. The lower bearing 22 is internally secured to the exterior of the shaft 21 by any suitable means, as for example, by the use of epoxy resin glue. The upper adapter cup 54 is then applied over the lower end of the hollow shaft 21, and the coil spring 58 is inserted between the two adapter cups 54 and 52. The upper cover 28 of the rotor having a central opening therein surrounded by a downturned flange or collar 30' is then placed over the upper ends of the loosely assembled shaft 21 and sleeve 24, and the upper bearing 20 is then inserted between shaft 21 and sleeve 24. The bearing 20 may also be adhesively secured to the upper end of the shaft 21, and the collar or flange 30' of cover 28 is then secured to the upper end of the sleeve 24 to rotate therewith. The exteriors of the bearings 20 and 22 are smooth and may be provided with polished surfaces to permit free rotation of the rotor sleeve 24 about the shaft 21 when the reaction jets 34,34' are in operation to actuate the centrifugal separator or rotor. Oil within the space 25 aids in lubricating the bearings.

The peripheral portion of the rotor cover 28 is connected to the side wall 27 of the rotor 11 by the spun-on connection 29. It will be apparent that the baffle plate 38 must be secured to the outer wall 27 prior to the application of the rotor cover 28. Likewise the upper baffle or ring 42 must be applied to the sleeve 24 prior to application of the cover 28, and is rotatable with the sleeve 24.

After the rotor cover 28 has been applied, the adapter funnel 17 may be inserted within the upper portion of the hollow shaft 21 and may be adhesively secured to the bearing 20 if desired. The heavy end cover 12 of the outer casing 10 is then inserted in the upper portion thereof and the annular gasket 60 with its annular seat 62 is placed over the top of the cover 12. The gasket seat 62 is previously secured to the upper rim of the housing 10 by means of the spun-on connection 64. The spring member 58, when inserted between the adapter cups 52 and 54, serves to press the entire rotor assembly, together with the non-rotatable stem 21, upwardly against the cover adjacent the threaded inlet 13, the sealing ring 18 having been applied beneath the cover 12 prior to its application to the housing 10.

Operation

In operation, oil under high pressure enters the cartridge unit through the threaded opening 13 as indicated by the arrow, passes downwardly through the funnel shaped adapter 17, where swirling of the oil is initiated, into the perforated inner shaft 21, and then outwardly through the openings 71 and 72 in the shaft 21 and sleeve 24, respectively. The oil passes outwardly beyond the baffle 42, and when the reaction jets 34, 34' are in operation in response to oil flow, foreign matter or sludge, being heavier than oil, is separated therefrom by centrifugal action and tends to settle on the wall 27 which serves as a collector for the sediment. The oil after the sludge containing heavy impurities has been separated, passes inwardly as indicated by the arrows and through the opening 40 in the bottom 31 of the rotor unit into the space below the plate 38, and thence outwardly to the jet cups 33, 33'. The pressure of the oil from the engine A (FIG. 1) entering and passing through the engine block B, rotor unit 11 and jets 34, 34' (FIG. 3) in cups 33, 33', causes rotation of the centrifugally actuated rotor unit 11. Clean oil from which heavy sludge particles have been removed within the rotor 11, passes under pressure into the space 40' immediately below the tapered lower end cover 31 of the rotor 11 and thence to the flow-straightening means 43 where swirling is stopped. The clean oil flows at reduced speed through the outlet 48 and thence through connection D (FIG. 1) to the crankcase E of the engine. Spin-on full flow filters A',A" may be used for filtering oil for the complete engine as well as the oil going through the bypass centrifugal filter A.

As will be apparent from the foregoing, the main stream of liquid from the engine is pretreated by passing through one or more full flow filters A' or A" which may be of the convential type and is also bypassed to the centrifugal separator A of the present invention. This improved arrangement tends to reduce expense and prevents engine wear as indicated earlier in this specification.

Figure 6:
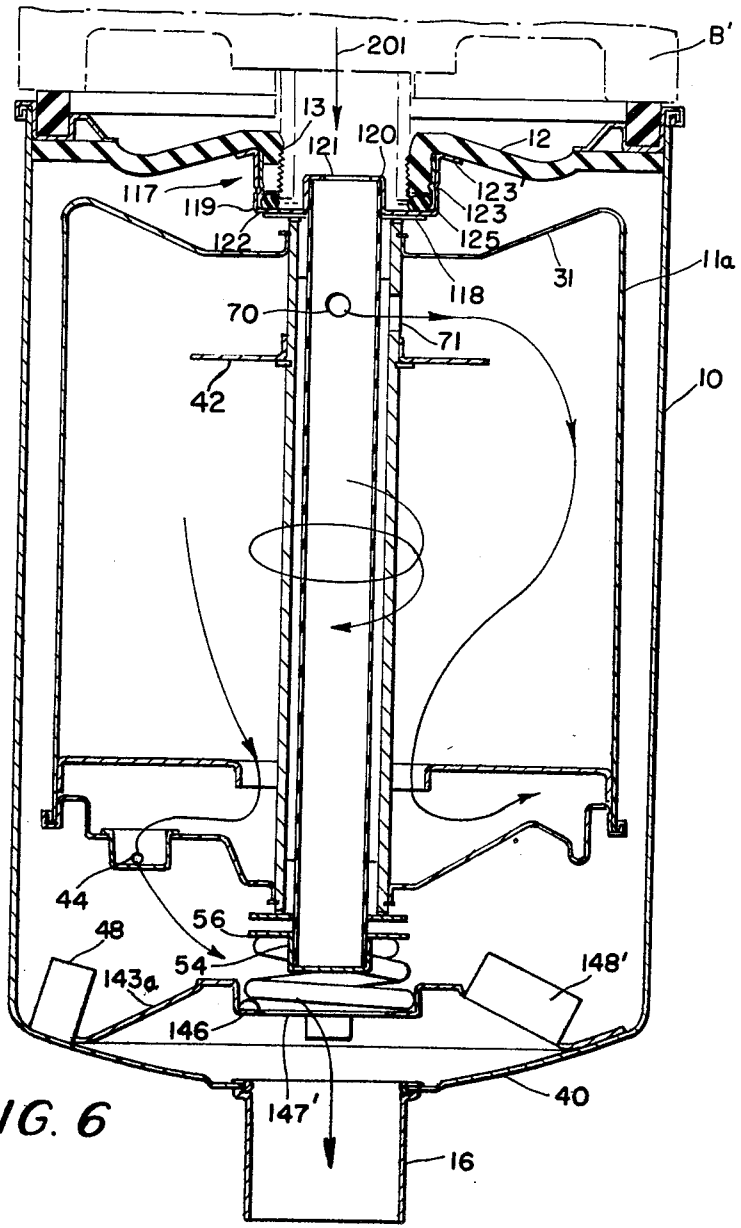
FIG. 6 is a view similar to FIGS. 3 and 5 showing a further modification.

Modifications FIGS. 5 and 6

The present disclosure represents various stages of developments of the invention for specific applications, and the foregoing description of FIGS. 3 and 4 and the method of assembly and operation represent the preferred embodiment at the time such structure was conceived. Later experimentation has shown that certain changes may be preferred for particular applications and the modifications shown in FIGS. 5 and 6 have been developed for such purposes. Accordingly, FIGS. 5 and 6 will be further described with particular reference to the changes over the embodiments shown in FIGS. 3 and 4 although the basic features of the invention remain the same. Thus in the structure shown in FIGS. 5 and 6, it will be understood that the same general arrangement of parts is maintained, namely, (1) an outer housing, casing or canister 10 having a removable spin-on cover 12 provided with a screw-threaded fluid inlet 13 and an outlet 16; (2) a jet propelled rotor 11 mounted within the outer casing or housing; (3) a non-rotatable hollow stem or shaft 21 removably connected to the cover of the outer casing or housing, on which hollow shaft 21 the rotor 11 is mounted. The hollow shaft 21 is connected through openings 71 and 72 to the interior of the rotor 11 to allow fluid (oil) to pass there through; (4) adapter means 17 connecting the fluid inlet 13 of the outer casing to the inlet 14 of the hollow shaft and with the interior of the rotor; (5) anti-swirling or baffle means/43 fixedly mounted at the outlet of the outer casing in such a way as to allow oil to pass therethrough to the outlet of the casing; (6) spring supporting adapter means 52 carried by the anti-swirling device or baffle means 43, and (7) resilient means 58 supported by the adapter for urging the assembly including the rotor and hollow stem into sealing engagement with the housing inlet. The numerals used above as those used in connection with FIGS. 3 and 4 but equivalent means are employed in FIGS. 5 and 6 as will be more fully described.

FIG. 5

In accordance with the embodiment shown in FIG. 5, the funnel adapter means 17 is spot welded to the reinforcing plate or cover 12 as indicated at 200. This construction has been found to reduce the loading of the spring 58 so that less over-all stress of assembly is incurred.

Additionally the anti-swirling means 43 (FIGS. 3 and 4) carrying the adapter cup 52 which supports the spring 58 has been changed and is herein referred to as unit 143, and instead of comprising a plurality of intersecting ribs 44 and 45, as in FIGS. 3 and 4, our improved anti-swirling device 143 is in the form of a hollow conical plate 144 secured at its base 145 to the bottom 46 of the outer housing or casing 10. As shown, the conical plate 144 is truncated to provide a seat 146 for the spring 58. One or more openings 147 and 147' are provided in the plate 144 to allow treated oil to pass to the casing outlet 16 as indicated by the arrows, after leaving the jet cups 33,33' of the rotor 11. One or more anti-swirling vanes 148 herein shown as integral with the plate 144 perform the function of the intersecting ribs 44 and 45 shown in FIGS. 3 and 4, but in a more efficient manner.

We have found that the above modifications make it possible to shorten the over-all length of the spin-on can for assembly purposes which is desirable in certain instances.

FIG. 6

The modification shown in FIG. 6 is generally similar in operation to the form shown in FIGS. 3, 4 and 5.

The changes in the anti-swirling means described in connection with FIG. 5 and referred to therein by reference numeral 143 are included in FIG. 6 and designated by the reference numeral 143 and need not here be further described.

The principal modification in FIG. 6 resides in the fact that the rotor unit designated 11 in FIGS. 3, 4 and 5 is in FIG. 6 reversed end for end, and the rotor unit in FIG. 6 will be generally designated by the reference numeral **11*a* but the respective parts of the rotor unit 11*a* and their operation are substantially as shown and described in connection with FIGS. 3, 4 and 5**.

As shown in FIG. 6, the rotor unit **11*a* includes a hollow sleeve 24*a* similar to the sleeve 24 in FIGS. 3, 4 and 5. This sleeve forms part of the rotor unit 11*a* and rotates therewith. The sleeve 24*a* is rotatably mounted on bearings on the non-rotatable hollow shaft 21 which is the same as that shown and described in FIGS. 3, 4 and 5**.

The jets 44 and 44' previously described, function in connection with FIGS. 3, 4 and 5, are now located in the removable cover 28 which is now at the bottom of the rotor **11*a*, and the integral cover 31 is shown at the top of the rotor in FIG. 6**.

The upper deflector plate 42 carried by the rotor sleeve **24*a* and the oil inlet aperture 71 in the rotor sleeve 24*a*, will now be located adjacent the integral cover 31, and the centrally apertured lower deflector plate 38 will be located adjacent the removable cover 28 in which the jets 44 and 44' are peripherally mounted. The operation of the device will be generally similar to that described in connection with FIGS. 3, 4 and 5. Oil entering at the top of the non-rotatable hollow shaft 21 passes through aperture 70 in the hollow shaft 21 and then through aperture 71 in the hollow sleeve 24*a* and thence into the interior of the rotor 11*a* above the upper deflector plate 42, and thence as indicated by the arrows through the central opening in the deflector plate 38 and thence outwardly, as again indicated by the arrows to jets 44 and 44', and thence as further indicated by the arrows to the anti-swirling device 143*a* at the bottom of the outer casing 10 and thence out through the outlet 16 to the engine crankcase. Contaminants separated by the centrifugal action of the rotor 11*a* are collected on the wall 27 as previously described, and the oil which flows through outlet 16**, and returns to the crankcase has been purified by the operation of the improved centrifugal separator.

Oil Inlet Adapter—FIG. 6

A further modification is shown at the upper portion of FIG. 6. Thus instead of the funnel-shapped oil adapter 17 which in FIGS. 3, 4 and 5 connects the oil inlet 13 of the casing cover 12 with the oil inlet of the non-rotatable hollow shaft 21, a different form of oil inlet adapter herein referred to as 117, is disclosed in FIG. 6.

As shown the modified adapter 117 may include a thrust washer 118 which is fitted over the inlet end of the non-rotating hollow shaft 21 and rests upon the top edge of the rotor sleeve 24*a*. Fitting over the thrust washer 118 and also over the open upper end of the hollow shaft 21 is a sealing unit 119 which may be formed of flexible metal, plastic or other suitable material. The sealing unit 119 includes a cap portion 120 which snugly fits over the inlet end of the non-rotating end of the hollow shaft and is provided with an opening 121 to allow passage of oil therethrough and thence through apertures 70 and 71 in the shaft 21 and rotor sleeve 24*a* respectively to the interior of the rotor 24*a*. The sealing unit 119 also includes a flange portion 122 extending radially from the cup portion 120 and an outer cylindrical portion 123 extending upwardly from the periphery of the flange 122, terminating in an upper peripheral flange portion 123', which, when the parts are assembled, is adapted to snugly fit the underside of the housing cover 12. The cylindrical portion 123 in the assembled position fits over the unthreaded exterior of the internally screw-threaded inlet portion 13 of the cover 12 and an O-ring seal member 125 is provided to ensure a leak proof connection. When the parts are assembled, the rotor unit 11*a* including the hollow shaft 24*a* is urged upwardly by the coil spring 58 seated on adapter cap 52*a* at the center of the fixed anti-swirling member 143*a*, mounted on bottom 40 of the housing or casing 10. As shown the cap 54 closes the lower end of the hollow shaft 21 and is provided with a flange 56 for engagement by the upper end of the spring 58. This arrangement has been previously described in connection with FIGS. 3 and 4. A second thrust washer 126 may be provided for engagement with the lower edge of the rotor sleeve 24*a* and is fitted over the lower portion of the stem 21.

Further Modifications

Figure 7:
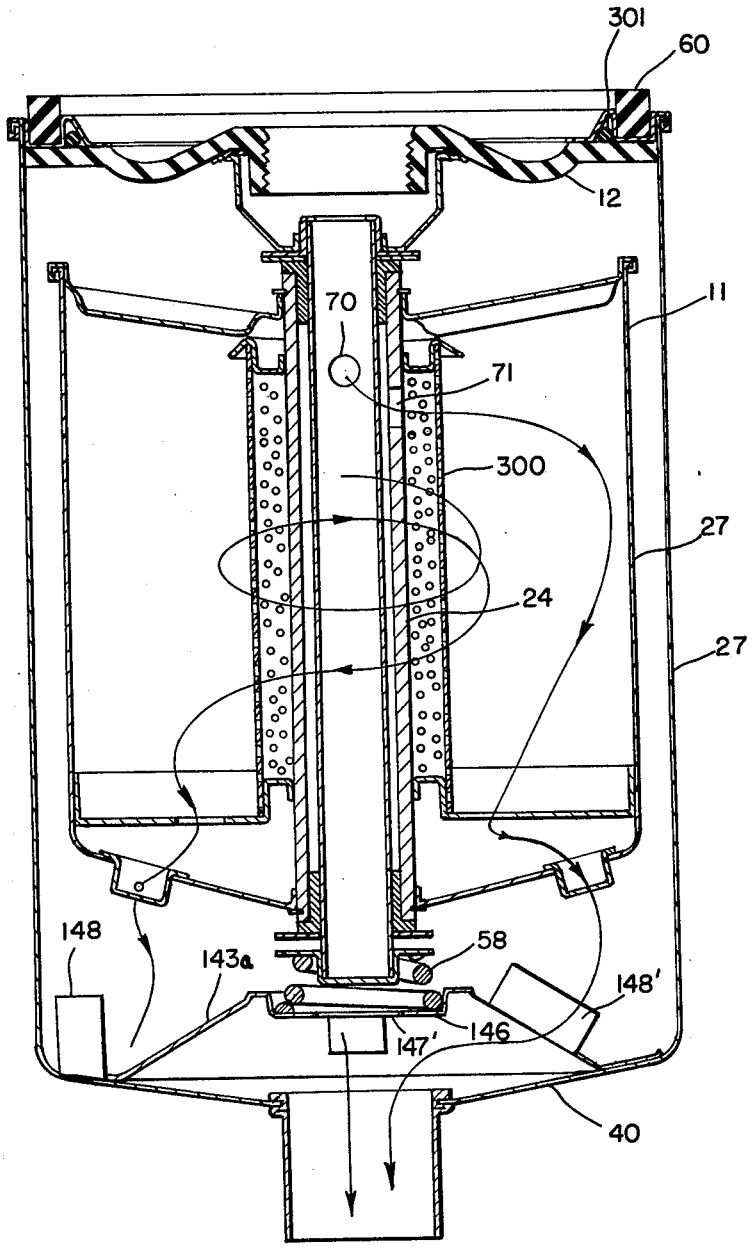
FIG. 7 is a view similar to FIG. 5 but showing a perforated sleeve within the rotor and intermediate the inner rotor sleeve and the outer rotor casing, and also showing a gasket under the cover and between the reinforcing plate and the cover to act as a seal between these two items.

FIG. 7 is a view similar to FIG. 5 but showing a perforated tubing or sleeve 300 within the rotor 11 and interposed between the inner rotor sleeve 24 and the outer rotor casing 27. Also a gasket 301 is added under the cover and between the cover and the reinforcing plate to act as a seal between these two items. Also the upper and lower deflector plates 42 and 38 of FIGS. 3, 4, 5 and 6 are not shown.

Figure 9:
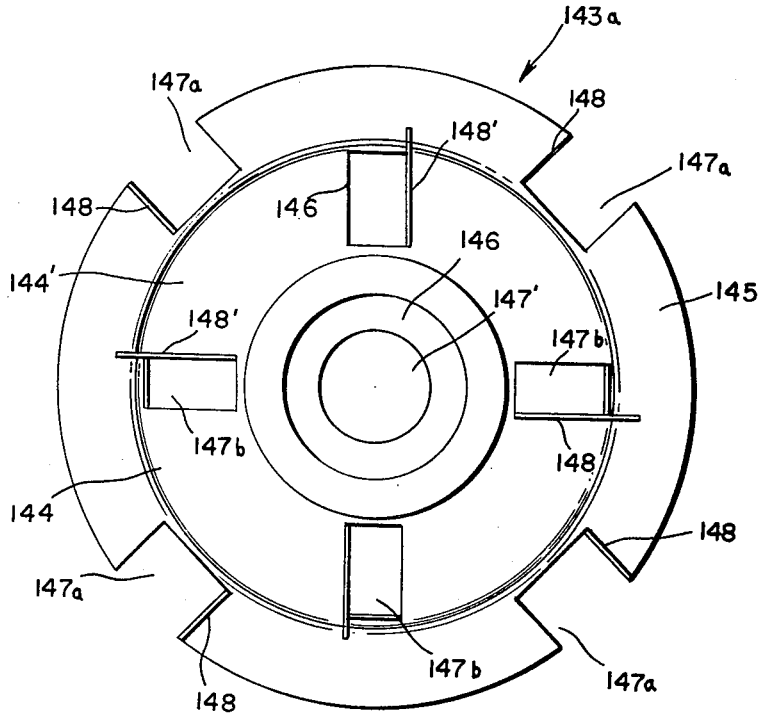
FIGS. 8 and 9 are respectively a vertical section and a top plan detailed view of the modified one piece anti-swirling device secured to the bottom of the outer housing or casing adjacent the outlet end thereof in FIGS. 5, 6 and 7 to take the place of the intersecting vanes of the anti-swirling device shown in FIGS. 3 and 4.
Figure 8:
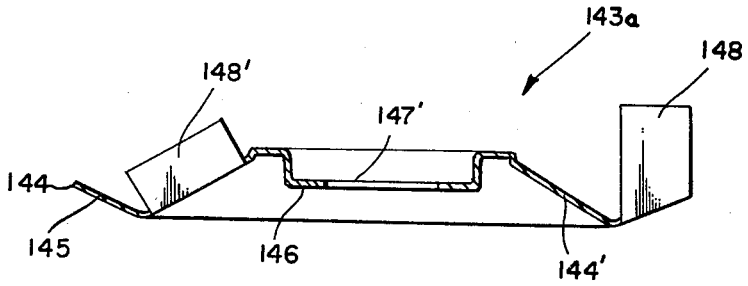

FIGS. 8 and 9 are respectively a vertical section and a top plan view of the modified anti-swirling device 143*a* which is secured in the bottom of the outer housing or casings in FIGS. 6 and 7 in place of the intersecting vanes of the anti-swirling device shown in FIGS. 3 and 4.

The anti-swirling unit 143*a* differs only slightly from the anti-swirling unit 143 shown in FIG. 5. Corresponding elements of the anti-swirling units 143 and 143*a* have been given like reference numerals. The anti-swirling unit 143*a* is in the form of a hollow conical plate 144 having a base flange 145 which conforms in shape to the interior surface of the bottom 46 of the casing 10 to which it is secured. As shown, the conical plate 144 is truncated to provide a depressed circular seat 146 for the coil spring 58. A first set of rectangular vanes 148 are struck out of the base flange 145 at equally spaced intervals and they are bent upright perpendicular to the base flange. When the vanes 148 are struck from the base flange 145, openings 147*a* are formed in the base flange. A second set of rectangular vanes 148' are struck out of the conical portion 144' of plate 144 at equally spaced intervals leaving openings 147*b* in the conical portion 144'. The vanes 148', like the vanes 148, are bent upright perpendicular to the plate 144. The second set of vanes 148' make an angle of 45 degrees with respect to the first set of vanes 148. A central opening 147' is formed in the depressed seat 146 which, like the openings 147*b* provides an oil flow passage from the jets 44 and 44' to the outlet 16.

At the present stage of development, the construction shown in FIGS. 5 and 7 are preferred. The form shown in FIG. 6 is still in the development stage and may be preferred for certain types of operation, subject to possible further modification.

General Operation, FIGS. 5, 6 and 7

As previously pointed out, the general operation of FIGS. 5, 6 and 7 is substantially the same as that described in connection with FIGS. 1–4.

In FIG. 5, the principal distinction over what is shown in FIGS. 3 and 4 resides in the construction of the anti-swirling device 143 which is substituted for the anti-swirling device 43 of FIGS. 3 and 4. In FIG. 5, the anti-swirling device 143 is in the form of an inverted dish or plate having a centrally located depression in its upper portion for receiving one end of the coil spring 58 which serves to urge the rotor 11, the hollow shaft 21 and the oil inlet adapter 17 upwardly into sealing engagement with the underside of the cover 12 of the outer casing or housing 10. In this case, the adapter 17 is welded to the underside of the cover plate. The seat for the lower end of the spring 58 may be either a depression in the top of the adapter plate 143 or may be a separate cap as in the arrangement shown in FIGS. 3 and 4. The operation of FIG. 6 is also substantially the same as that set forth in FIGS. 1–4, and is clearly indicated by the arrows showing the passage of fluid (oil) through the base casting B' of the engine through oil inlet adapter 117 and thence into the top of the hollow shaft 21, through openings 70 and 71 into the interior of the rotor casing where contaminants are removed from the oil by centrifugal action. Oil from which contaminants have been removed passes through the central opening in the baffle plate 38 and thence outward through jets 44 and 44' to the anti-swirling device 143*a* in the bottom of housing 10 and thence through the outlet 16 back to the crankcase of the engine.

Preferred embodiments of the invention have been described in detail for the purpose of illustration but it will be obvious that numerous modifications and variations may be resorted to without departing from the spirit of the invention in its broadest aspects.

What is claimed is:

1. A centrifugal separator cartridge comprising a cylindrical spin-on housing having opposite inlet and outlet ends and an intermediate cylindrical wall connected to said ends, a screw threaded inlet through said inlet end for liquid to be treated, an outlet through said outlet end for treated liquid, a hollow inner shaft non-rotatably mounted longitudinally within said spin-on housing, first adapter means separably connecting one end of said inner shaft with the inlet of said housing for passage of liquid through said inlet into said shaft, longitudinally spaced bearing members encompassing the exterior of said inner shaft adjacent its opposite ends, a centrifugal separator rotor unit within said housing rotatably mounted by said bearing members on said inner shaft, said rotor unit comprising a cylindrical rotor casing having opposite end covers provided with aligned end openings, a sleeve mounted in said opposite end covers and extending through said end openings to rotate with said rotor casing, said bearing members being fitted in opposite ends of said sleeve and spacing said sleeve from said inner shaft, the inner shaft and bearing members projecting longitudinally beyond the end openings in the rotor casing and covers, said rotor unit being supported upon said inner shaft in longitudinally spaced relationship with inlet and outlet ends of said housing, the inner shaft and sleeve having coacting peripheral openings adjacent the inlet ends thereof to permit the flow of liquid directly into the interior of the rotor casing, said rotor unit having outlet liquid jet means providing liquid flow between the interior of the rotor unit and the interior of the housing whereby jet reaction forces rotate the rotor unit, a second adapter capping the end of said inner shaft opposite its inlet end, a spring supporting pedestal secured within said housing and longitudinally spaced between said rotor unit and the outlet of the housing, a spring supporting recess within said pedestal, and spring means having one end seated in said recess and another end pressed against said second adapter means and urging said second adapter means, said rotor unit, said inner shaft and first adapter means together toward said inlet end of said housing where said first adapter means is pressed against the inlet end of said housing, said spring supporting pedestal having liquid passage means therethrough for liquid flow from said rotor unit to said housing outlet, and said first adapter being a funnel-shaped member having an enlarged end seated against the inlet end of said housing about said inlet and a reduced neck portion fitting into the inlet end of said inner shaft.

2. A centrifugal separator cartridge as defined in claim 1 wherein said spring supporting pedestal includes a pair of intersecting vanes secured in said housing.

3. A centrifugal separator cartridge as defined in claim 2 wherein said spring supporting recess is provided at the intersection of said vanes and an adapter cup is mounted in said recess to support said one end of said spring.

4. A centrifugal separator cartridge as defined in claim 1 wherein said enlarged end has an outwardly extending peripheral flange.

5. A centrifugal separator as defined in claim 4 together with a gasket interposed between said flange and the inlet end of said housing for providing a seal between the adapter and the inlet end of said housing.

6. A centrifugal separator cartridge as defined in claim 1 wherein said rotor unit is radially spaced inwardly from the cylindrical wall of said housing, and said cylindrical wall of said housing is provided with annular baffle means secured to and projecting inwardly from the cylindrical wall adjacent the outlet end of the rotor to retard reverse flow of liquid between the rotor and the cylindrical wall of said housing after liquid leaves the rotor.

7. A centrifugal separator cartridge as defined in claim 1 wherein first deflector means is provided for deflecting liquid entering the rotor unit from the perforated portion of the inner rotary sleeve comprising an annular plate secured to the rotary hollow sleeve just below the coacting peripheral openings in the hollow shaft and sleeve.

8. A centrifugal separator cartridge as defined in claim 1 comprising first deflector means for deflecting liquid entering the rotor from the perforated portion of the inner rotary hollow sleeve outwardly against the outer casing to separate heavier contaminating material therefrom, comprising an annular plate secured to the rotary hollow sleeve, and second deflector means for deflecting liquid inwardly from the rotor casing spaced lengthwise from the first deflector means, and comprising an annular plate secured to the rotor casing having a central opening surrounding the sleeve to permit liquid from which said heavier contaminating material has been removed, to pass therethrough.

9. A centrifugal separator cartridge as defined in claim 1 wherein the outer housing is provided with a removable inlet end cover, including the inlet means being for liquid to be treated, and adapter means secured within the said cover operatively connecting the liquid inlet means of the outer housing with the liquid inlet means of the rotor unit.

10. A centrifugal separator cartridge as defined in claim 1 wherein the rotor unit comprises an outer sidewall portion for collecting relatively heavy contaminants separated from the liquid by centrifugal action of the rotor unit.

11. A centrifugal separator cartridge as defined in claim 10 wherein the rotor unit includes a cover portion integral with the side wall portion of the rotor, adjacent the inlet end of the outer casing or housing, and a separable cover at the outlet end having peripheral reaction jets mounted therein.

12. A centrifugal separator cartridge as defined in claim 1 wherein the centrifugal rotor unit includes a cylindrical outer wall portion for collecting heavy contaminants separated from the liquid to be treated by centrifugal action, an inner sleeve coaxial with the cylindrical outer wall portion, having an opening for liquid to be treated communicating with the interior of the rotor unit, and a foraminous sleeve intermediate the inner sleeve and outer casing for separating out large particles from the liquid being treated before entering the interior of the rotor casing.

13. The centrifugal separator according to claim 1 further comprising means for relieving pressure in said rotary unit when said liquid reaches a predetermined pressure.

14. The combination of a centrifugal separator cartridge as defined in claim 1 with one or more separable full flow filter units all coacting with an engine cylinder block for prefiltering contaminated liquid prior to further treatment in the centrifugal separator cartridge and return to the engine.

* * * * *